US007308226B2

(12) United States Patent
Iino et al.

(10) Patent No.: US 7,308,226 B2
(45) Date of Patent: Dec. 11, 2007

(54) IMAGE FORMING METHOD AND APPARATUS WITH REDUCED REVERSE TONER TRANSFER

(75) Inventors: Ayako Iino, Kanagawa (JP); Takahiro Tamiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 253 days.

(21) Appl. No.: 10/975,380

(22) Filed: Oct. 29, 2004

(65) Prior Publication Data

US 2005/0117938 A1 Jun. 2, 2005

(30) Foreign Application Priority Data

Oct. 31, 2003 (JP) ..... 2003-372339

(51) Int. Cl.
*G03G 15/20* (2006.01)

(52) U.S. Cl. ..... 399/313

(58) Field of Classification Search ..... 399/313, 399/298, 297

See application file for complete search history.

(56) References Cited

U.S. PATENT DOCUMENTS

| | | | | |
|---|---|---|---|---|
| 5,599,645 | A | 2/1997 | Tamiya et al. | |
| 5,678,161 | A | 10/1997 | Kurotaka et al. | |
| 5,740,492 | A | 4/1998 | Deki et al. | |
| 5,915,145 | A * | 6/1999 | Shimura et al. | 399/314 |
| 6,029,033 | A * | 2/2000 | Kawasaki | 399/299 |
| 6,134,416 | A | 10/2000 | Tamiya | |
| 6,184,910 | B1 | 2/2001 | Sasaki et al. | |
| 6,374,073 | B2 * | 4/2002 | Ozaki et al. | 399/298 |
| 6,611,672 | B2 * | 8/2003 | Aoki et al. | 399/359 |
| 6,618,565 | B2 | 9/2003 | Tamiya et al. | |
| 6,701,100 | B2 | 3/2004 | Tamiya et al. | |
| 6,741,821 | B2 | 5/2004 | Sugino et al. | |
| 6,879,793 | B2 * | 4/2005 | Chiba et al. | 399/149 |
| 6,938,351 | B2 * | 9/2005 | Kobayashi et al. | 399/313 |
| 2002/0106224 | A1 * | 8/2002 | Yamauchi et al. | 399/313 |
| 2004/0008999 | A1 | 1/2004 | Iino | |
| 2004/0105692 | A1 | 6/2004 | Tamiya et al. | |
| 2004/0126148 | A1 | 7/2004 | Iwai et al. | |

FOREIGN PATENT DOCUMENTS

JP 6-102783 4/1994

(Continued)

OTHER PUBLICATIONS

U.S. Appl. No. 11/367,541, filed Mar. 6, 2006, Tamiya, et al.

*Primary Examiner*—David M. Gray
*Assistant Examiner*—Ruth N. LaBombard
(74) *Attorney, Agent, or Firm*—Oblon, Spivak, McClelland, Maier & Neustadt, P.C.

(57) ABSTRACT

An image forming method of the present invention sequentially transfers toner images formed on image carrier to an intermediate image transfer body one above the other to thereby form a multicolor toner image. An image transfer roller faces the inside surface of the intermediate image transfer body for applying an image transfer bias when a toner image is transferred from the image carrier to the intermediate image transfer body. Rollers are positioned at both sides of the image transfer roller in the axial direction of the image transfer roller in order to control a nip width over which the image carrier and intermediate image transfer body contact each other during image transfer.

16 Claims, 8 Drawing Sheets

FOREIGN PATENT DOCUMENTS

| | | |
|---|---|---|
| JP | 9-305041 | 11/1997 |
| JP | 10-198197 | 7/1998 |
| JP | 3101276 | 8/2000 |
| JP | 2001-66908 | 3/2001 |
| JP | 2003-156947 | 5/2003 |

* cited by examiner

FIG. 8

| GAP (μm) | TRANSFER RATIO (%) | REVERSE TRANSFER RATIO (%) | OPTIMUM TRANSFER VOLTAGE (kV) | |
|---|---|---|---|---|
| | | | DC | AC |
| 0 (PRESSURE : PRIOR ART) | 98 | 17 | 1 | – |
| 0 (ROLLER : SAME DIAMETER) | 96 | 9 | 1 | – |
| 30 | 89 | 1 | 1 | 2 |
| 60 | 83 | 1 | 1.1 | 2.3 |
| 90 | 72 | 0 | 1.2 | 2.6 |
| 120 | 49 | 0 | 1.4 | 3 |

IMAGE FORMING METHOD AND APPARATUS WITH REDUCED REVERSE TONER TRANSFER

BACKGROUND OF THE INVENTION

1. Field of the Invention

The present invention relates to an image forming method for forming a multicolor or a full-color image with an electrophotographic process and an image forming apparatus using the same.

2. Description of the Background Art

One of conventional color image forming apparatuses is configured to sequentially transfer toner images of different colors from photoconductive drums or similar image carries to an intermediate image transfer body one above the other for thereby completing a multicolor toner image. The problem with this type of image forming apparatus is the reverse toner transfer to be described hereinafter. For example, in a tandem, image forming apparatus including a plurality of image forming sections arranged side by side and a single intermediate image transfer body, part of toner transferred to the intermediate image transfer body at an upstream image forming section is returned, or reversely transferred, to the image carrier of a downstream image forming section, giving rise to color mixture, image disturbance, smears and other defects. Such reverse toner transfer occurs when a bias for image transfer is applied at the downstream image forming section in order to transfer a toner image from the image carrier to the intermediate image transfer body, particularly in the non-image portions of the image carrier.

Reverse toner transfer is considered to derive from the following mechanism. The surface of the image carrier is charged to the same polarity as toner by charging means while the surface potential of the intermediate image transfer body is opposite in polarity to the toner or is 0 V. If a potential difference between the surface of the image carrier and that of the intermediate image transfer body is great, then the difference is particularly great in the non-image portions of the image carrier. In this condition, discharge occurs when the image carrier and intermediate image transfer body approach each other around a primary image transfer position, causing the resulting electronic ions to invert the charge polarity of part of the toner deposited on the intermediate image transfer body. Consequently, the toner thus inverted in polarity is subject to an electrostatic force acting toward the image carrier and is reversely transferred to the image carrier thereby.

Besides the electric influence stated above, reverse toner transfer is physically brought about by the influence of non-electrostatic adhering forces including an increase in toner adhering force that acts between the toner and the image carrier and toner adhering force that acts between them at the image transfer nip due to the pressure of an image transfer roller that presses the intermediate image transfer body against the image carrier. To obviate such a physical cause of reverse toner transfer, Japanese Patent Laid-Open Publication No. 2003-156947, for example, proposes to mount an abutment member on the shaft of a bias roller for primary image transfer, which faces an image carrier, via a bearing. The abutment member contacts the surface of the image carrier to thereby form a gap between the image carrier and an intermediate image transfer body. However, the resulting non-contact image transfer station obstructs faithful transfer of a toner image and brings about toner scattering.

On the other hand, Japanese Patent No. 3101276 discloses a color image recording apparatus including a pair of rollers held in contact with opposite end portions of a photoconductive drum in order to maintain the amount of nip between the drum and an intermediate image transfer body constant. Although such rollers maintain the nip width constant in contact with the photoconductive drum, they do not cope with reverse toner transfer at all.

Further, Japanese Patent Laid-Open Publication No. 9-305041 proposes to obviate reverse toner transfer by forming a gap between an image carrier and an image transfer roller and positioning the axis of the image transfer roller above the axis of the image carrier. This configuration, however, has problems left unsolved as to an increase in adhering force ascribable to the weight of a recording medium and the stability of image formation.

Technologies relating to the present invention are also disclosed in, e.g., Japanese Patent Laid-Open Publication Nos. 06-102783, 10-198197 and 2001-066908.

SUMMARY OF THE INVENTION

It is an object of the present invention to implement, in an image forming method of the type using an intermediate image transfer body, faithful transfer of a toner image and reduction of reverse toner transfer by controlling the width of an image transfer nip in the event of transfer of a toner image from an image carrier to the intermediate image transfer body to thereby effect image transfer in the absence of image transfer pressure.

It is another object of the present invention to provide an image forming apparatus capable of reducing reverse toner transfer by using the above image forming method.

An image forming method of the present invention sequentially transfers toner images of different colors formed on an image carrier to an intermediate image transfer body one above the other to thereby form a multicolor toner image. An image transfer roller faces the inside surface of the intermediate image transfer body for applying an image transfer bias when a toner image is transferred from the image carrier to the intermediate image transfer body. Rollers are positioned at both sides of the image transfer roller in the axial direction of the image transfer roller in order to control a nip width over which the image carrier and intermediate image transfer body contact each other during image transfer.

An image forming apparatus using the above image forming method is also disclosed.

BRIEF DESCRIPTION OF THE DRAWINGS

The above and other objects, features and advantages of the present invention will become more apparent from the following detailed description taken with the accompanying drawings in which:

FIG. 8 is a table showing a relation between a gap between an intermediate image transfer belt and an image transfer roller and an image transfer ratio, a reverse transfer ratio and an optimum image transfer voltage.

DESCRIPTION OF THE PREFERRED EMBODIMENT

Figure 1:
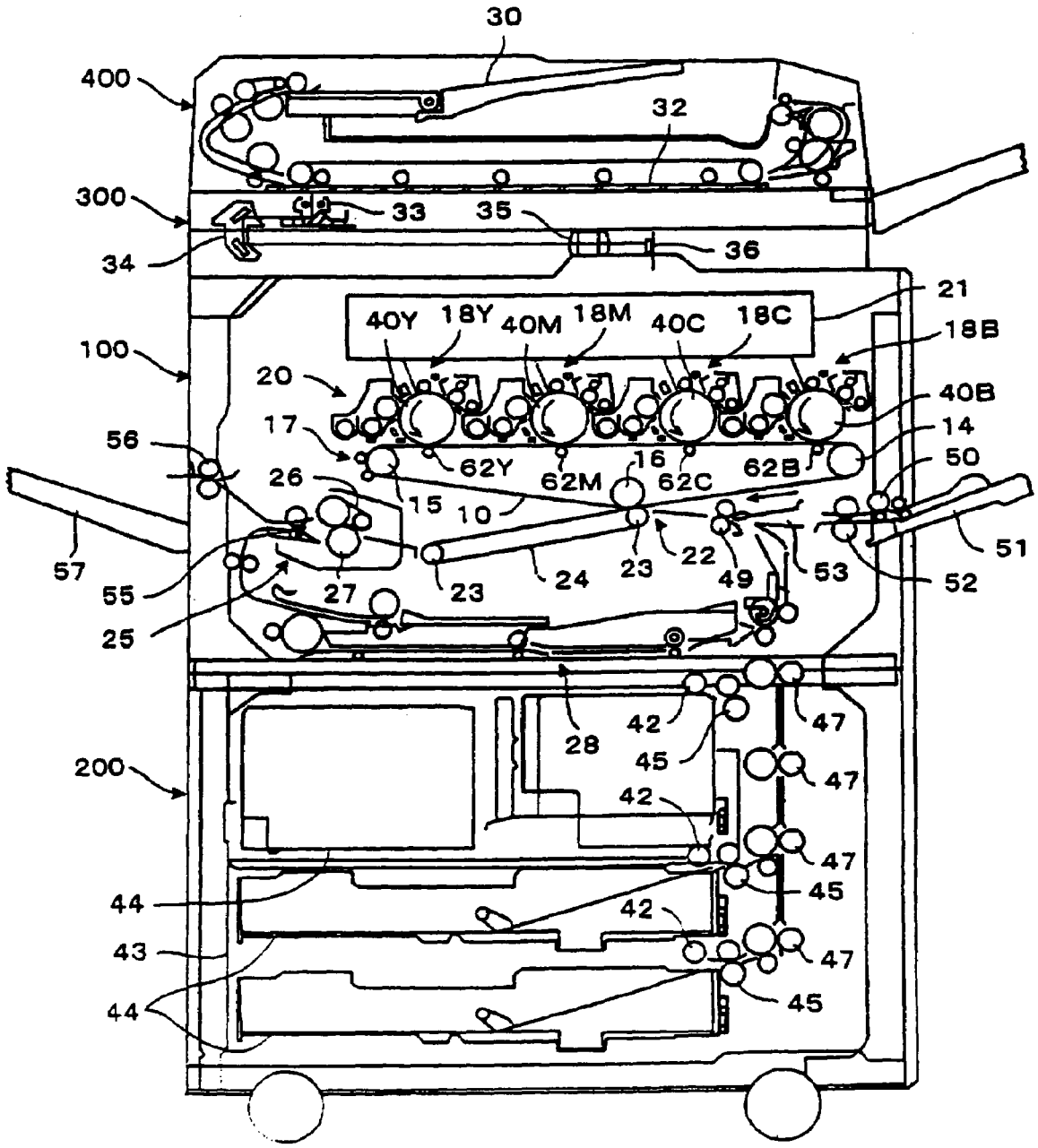
FIG. 1 is a view showing the general construction of an image forming apparatus embodying the present invention.

Referring to FIG. 1 of the drawings, an image forming apparatus embodying the present invention is shown and implemented as a tandem, intermediate image transfer type of color copier by way of example. As shown, the color copier includes a copier body or apparatus body 100 constituting a color printer section and mounted on a sheet feed table 200. A scanner or document reading device 300 is mounted on the copier body 100 while an ADF (Automatic Document Feeder) 400 is mounted on the scanner 300. An endless, intermediate image transfer belt, or intermediate image transfer body, 10 is positioned at the center of the copier body 100 and serves as a primary image transfer medium.

As shown in FIG. 1, the intermediate image transfer belt 10 (simply belt 10 hereinafter) is passed over a first support roller 14, a second support roller 15 and a third support roller 16 and caused to turn clockwise. In the illustrative embodiment, a belt or intermediate image transfer body cleaning device 17 is positioned at the left-hand side of the second support roller 15 in order to remove residual toner left on the image transfer belt 10 after image transfer. A tandem, image forming section 20 is arranged above the upper run of the image transfer belt 10 between the first support roller 14 and the second support roller 15. In the image forming section 20, four image forming means 18Y (yellow), 18M (magenta), 18C (cyan) and 18B (black) are arranged in the horizontal direction, i.e., in a tandem configuration. It should be noted that the arrangement of colors shown in FIG. 1 is only illustrative and may be varied, as desired.

Figure 2:
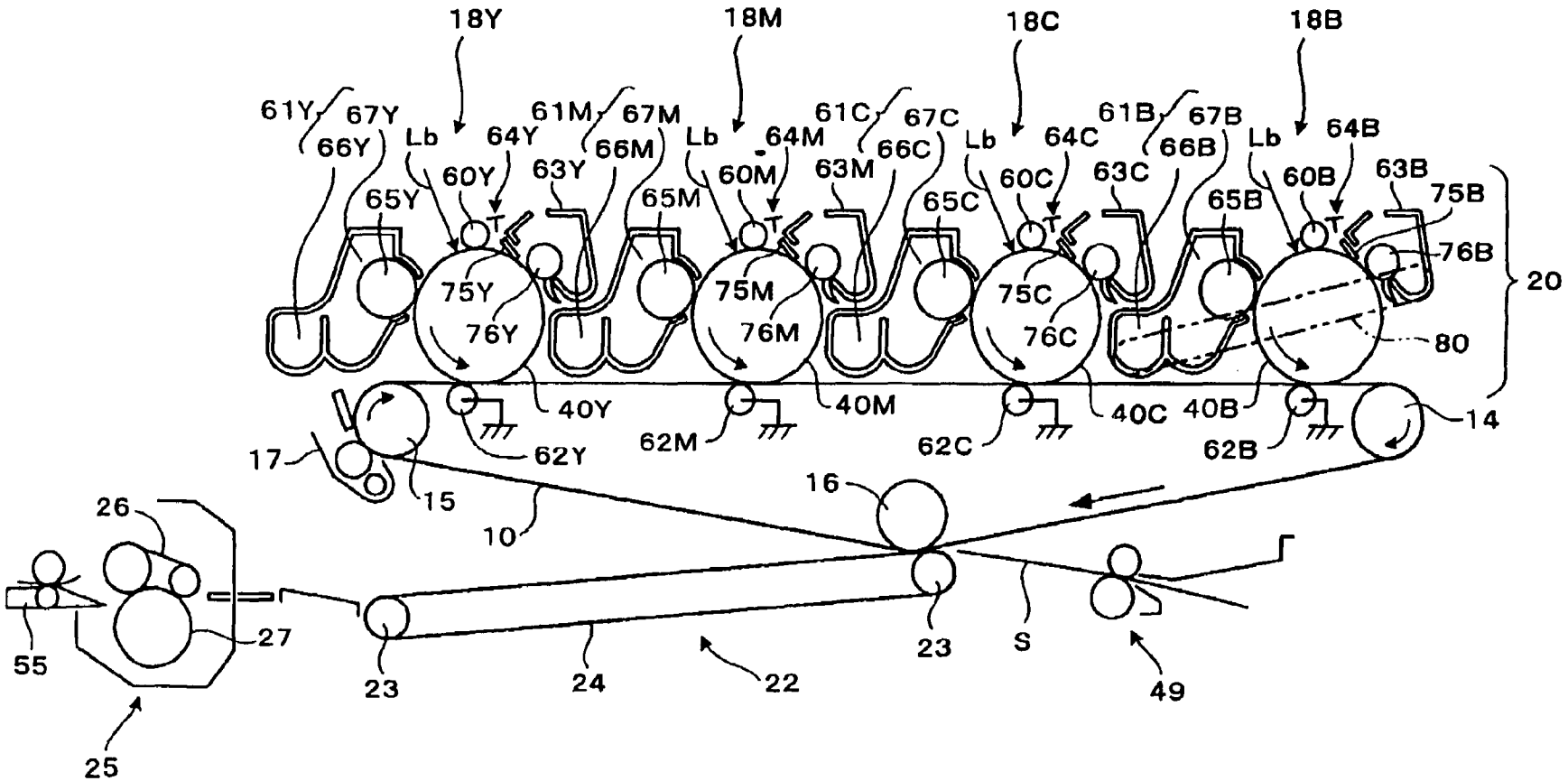
FIG. 2 is a fragmentary enlarged view showing a tandem, image forming section included in the illustrative embodiment.

FIG. 2 shows the tandem, image forming section 20 in a fragmentary enlarged view. As shown, the image forming means or toner image forming means 18Y, 18M, 18C and 18B include photoconductive drums or image carriers 40Y, 40M, 40C and 40B, respectively. Arranged around the drum 40Y are a charger 60Y, a developing unit 61Y, an image transfer roller or similar primary image transferring device 62Y, a drum cleaner 63Y and a discharger 64Y. Likewise, chargers 60M, 60C and 60B, developing units 61M, 61C and 61B, image transfer drums 62M, 62C and 62B, drum cleaners 63M, 63C and 63B and dischargers 64M, 64C and 64B are arranged around the drums 61M, 61C and 61B, respectively.

In the illustrative embodiment, the chargers 60Y through 60B each are implemented as a charge roller or charging member configured to apply a voltage to associated one of the drums 40Y through 40B in contact therewith for thereby uniformly charging the surface of the drum. Of course, the charge rollers are only illustrative and may be replaced with charge brushes or non-contact scorotron chargers by way of example.

Referring again to FIG. 1, an exposing unit 21 is positioned above the image forming section 20. A secondary image transferring device or secondary image transferring means 22 is located at the opposite side to the image forming section 20 with respect to the belt 10. In the illustrative embodiment, the secondary image transferring device 22 includes an endless, secondary image transfer belt 24 passed over two rollers 23 and pressed against the third support roller 16 via the image transfer belt 10 so as to transfer a toner image from the belt 10 to a paper sheet, OHP (Over-Head Projector) sheet or similar sheet S, which is a specific form of a recording medium. A fixing unit 25 is positioned at the left-hand side of the secondary image transferring device 22, as viewed in FIG. 1, and configured to fix the toner image thus carried on the sheet S. The fixing unit 25 includes a press roller 27 pressed against a fixing belt or fixing member 26, which may be implemented as a fixing roller, if desired.

The secondary image transferring device 22 additionally functions to convey the sheet S carrying a toner image thereon to the fixing unit 25. Of course, the secondary image transferring device 22 may alternatively be implemented by an image transfer roller or a non-contact type of charger although it would be difficult to obtain the sheet conveying function at the same time with such an alternative implement. In the illustrative embodiment, a sheet turning device 28 is arranged beneath the secondary image transferring device 22 and fixing unit 25 in parallel to the image forming section 20 and configured to turn over the sheet S in a duplex copy mode, i.e., when images should be transferred to both surfaces of the sheet S.

Now, the operator of the color copier, intending to copy a desired document, sets the document on a document tray 30 included in the ADF 400 or opens the ADF 400, sets the document on a glass platen 32 included in the scanner 300 and again closes the ADF 400 so as to press the document therewith. Subsequently, when the operator presses a start switch, not shown, the document set on the ADF 400 is conveyed to the glass platen 32 by the ADF 400. After such conveyance of the document to the glass platen 32 by the ADF 400 or immediately after the manual setting of the document on the glass platen 32, the scanner 300 is driven to cause a first carriage 33 loaded with a light source and a mirror and a second carriage 34 loaded with two mirrors to start running.

In the above condition, while the light source of the first carriage 33 illuminates the document, the resulting image-wise reflection from the document is reflected by the mirror of the first carriage 33 toward the second carriage 34. The two mirrors of the second carriage 34 reflect the imagewise light toward an image sensor 36 via a lens 35, causing the image sensor 36 to read the image of the document. The image sensor 36 is implemented by a color CCD (Charge Coupled Device) or similar color image pickup device.

In the image forming means 18Y, for example, while the drum 40Y is in rotation, the charger 60Y uniformly charges the surface of the drum 40Y. This is also true with the other image forming means 18M, 18C and 18B except that the drum 40Y is replaced with the drums 40M, 40C and 40B and that the charger 60Y is replaced with the chargers 60M, 60C and 60B. Subsequently, a laser diode or a light-emitting diode included in the exposing unit 21 emits light beams Lb each being representative of a particular color component read by the scanner 300. The light beams Lb each scan the charged surface of particular one of the drums 40Y through 40B, electrostatically forming a latent image.

The developing units 61Y, 61M, 61C and 61B mentioned earlier respectively include developing sections 67Y, 67M, 67C and 67B accommodating developing rollers or sleeves 65Y, 65M, 65C and 65B, respectively. The developing unit 61Y, for example, develops the latent image formed on the drum 40Y with toner contained in a developer, which is deposited on the developing roller 65Y, thereby producing a yellow toner image. The other developing units 61M, 61C and 61B operate in the same manner as the developing unit 61Y, producing a magenta, a cyan and a black toner image, respectively. A drive motor, not shown, is driven in synchronism with such an image forming operation so as to rotate one of the first to third support rollers 14 through 16 for thereby causing the belt 10 to turn. Substantially at the same time, image transfer biases are applied to the image transfer rollers or primary image transferring devices 62Y through 62B. As a result, the toner images present on the drums 40Y through 40B are sequentially transferred to the image transfer belt 10 one above the other, completing a four-color or composite color image on the belt 10. Primary image transfer mentioned previously refers to this image transferring step.

After the primary image transfer described above, the drum cleaners 63Y through 63B remove residual toners left on the drums 40Y through 40B, respectively. Subsequently, the dischargers 64Y through 64B respectively discharge the surfaces of the drums 40Y through 40B to thereby prepare them for the next image formation.

The sheet feed table 200 mentioned earlier accommodates a sheet bank 43 in which a plurality of sheet cassettes 44 are arranged one above the other. When the operator of the printer presses a start switch, not shown, a pickup roller 42 assigned to one of the sheet cassettes 44 selected pays out sheets or recording media S from the sheet cassette 44. At this instant, a separator roller 45 associated with the above pickup roller 42 separates the top sheet S from the other sheets underlying it. The sheet S thus paid out is conveyed by rollers 47 to a sheet path arranged in the copier body 100 and is then stopped by a registration roller pair 49. On the other hand, when special sheets S are set on a manual feed tray 51, a pickup roller 50 pays out the sheets S while a separator roller 52 separates the top sheet S from the underlying sheets S. The special sheet S thus fed from the manual feed tray 51 is also brought to the registration roller pair 49 via a sheet path 53 and stopped thereby.

The registration roller pair 49 is driven in synchronism with the movement of the composite color image formed on the belt 10, conveying the sheet S to a nip between the belt 10 and the secondary image transferring device 22. The secondary image transferring device 22 transfers the color image from the belt 10 to the sheet S.

The sheet S, now carrying the color image transferred from the belt 10, is conveyed by the secondary image transfer belt 24 (simply belt 24 hereinafter) to the fixing unit 25. The fixing unit 25 fixes the color image on the sheet S with heat and pressure, as stated previously. A path selector 55 steers the sheet S coming out of the fixing unit 25 toward an outlet roller pair 56. The sheet S is then driven out of the copier body 100 to the copy tray 57 by the outlet roller pair 56 as a simplex copy. On the other hand, in the duplex copy mode, the path selector 55 is so positioned as to introduce the sheet S into the sheet turning device 28. The sheet turning device 28 turns over the sheet S and again delivers it to the secondary image transfer station. Subsequently, after another image has been transferred to the reverse surface of the sheet S, the sheet S is driven out to the copy tray 57 via the outlet roller pair 56 as a duplex copy.

The belt cleaning device 17 removes toner left on the belt 10 after the image transfer to thereby prepare it for the next image formation.

The drum cleaners 63Y, 63M, 63C and 63B, configured to collect toners left on the associated drums after the primary image transfer, include cleaning blades 75Y, 75M, 75C and 75B, respectively. The cleaning blades 75Y through 75B are formed of, e.g., polyurethane and has edges pressed against the drums 40Y through 40B, respectively. Further, there are provided brushes rotatable in contact with the drums 40Y through 40B in order to enhance the cleaning ability of the drum cleaners 63Y through 63B. More specifically, in the illustrative embodiment, conductive fur brushes 76Y, 76M, 76C and 76B are held in contact with the drums 40Y, 40M, 40C and 40B, respectively, and rotated in the direction counter to the drums for thereby collecting the toners left on the drums.

Toner conveying devices or toner recycling means 80 connect the drum cleaners 63Y through 63B to the developing units 61Y through 61B, respectively. The toner conveying devices 80 respectively return the toners of different colors collected from the drums 40Y through 40B to toner replenishing sections 66Y, 66M, 66C and 66B, thereby allowing the toners to be again used for development. While only one toner conveying device 80 included in the rightmost image forming means 18B, as viewed in FIG. 2, is shown, such a toner conveying device is, of course, included in the other image forming means 18Y, 18M and 18C also.

In the tandem, intermediate image transfer type of color image forming apparatus described above, the present invention is characterized in that rollers are positioned at both sides of each of the image transfer rollers 62Y through 62B in the axial direction of the image transfer roller in order to control a nip width over which the drum 40 and belt 10 contact each other at the time of image transfer. Specific examples of the present invention will be described hereinafter.

EXAMPLE 1

Figure 3:
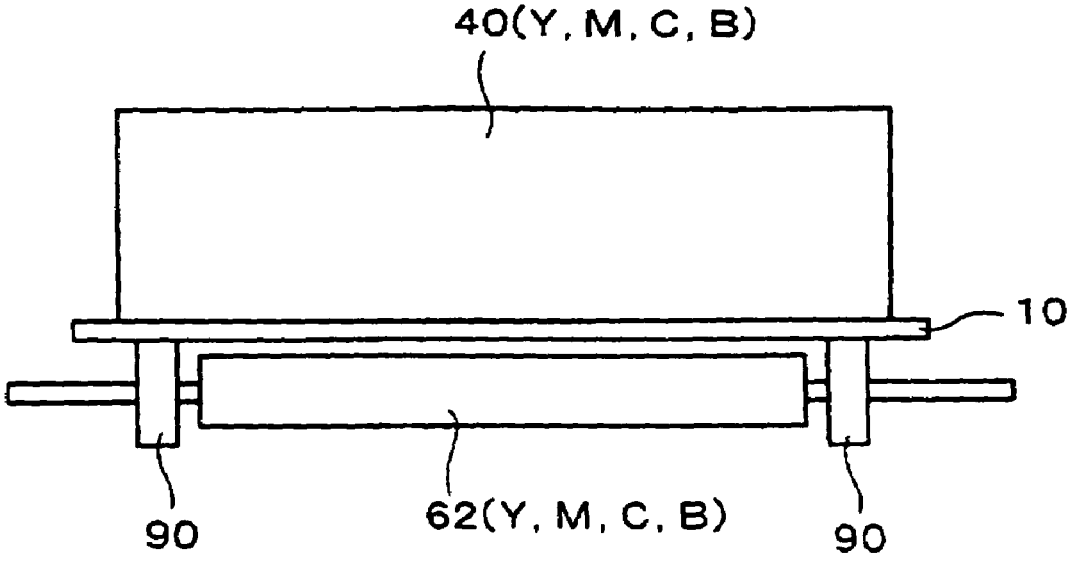
FIG. 3 shows one of a plurality of primary image forming stations included in Example 1 of the present invention.

FIG. 3 shows one of the four primary image transfer stations where toner images of different colors are sequentially transferred from the drums 40Y through 40B to the belt 10. The configuration of the primary image transfer station to be described hereinafter applies to the other primary image transfer stations as well.

As shown in FIG.3, in Example 1, rollers 90 are positioned at both sides of the image transfer roller 62, which faces the inner surface or inside surface of the belt 10, in order to control a nip width over which the drum 40 and belt 10 contact each other. The rollers 90 are provided with a larger diameter than the image transfer roller 62 so as to maintain the roller 62 spaced from the belt 10. More specifically, the rollers 90 so configured are held in contact with the non-image regions of the drum 40 via the belt 10 to thereby stably form a gap between the belt 10 and the image transfer roller 62. This prevents the image transfer roller 62 from contacting the belt 10 and thereby allows a contact width at the nip to be made as small as possible. Each roller 90 should only be sized to implement the required gap mentioned above.

In Example 1, the gap between the belt 10 and the image transfer roller 62 is selected to be 100 μm or below, more preferably between 20 μm and 50 μm, for reasons to be described specifically later. If desired, means for varying the above gap may be additionally included in Example 1. In the case where a plurality of drums are arranged side by side, as shown in FIGS. 1 and 2, the gap may be varied from one image transfer station to another image transfer station.

Further, the gap may not be provided at the image transfer station positioned at the most upstream side in the direction of movement of the belt 10.

Figure 4:
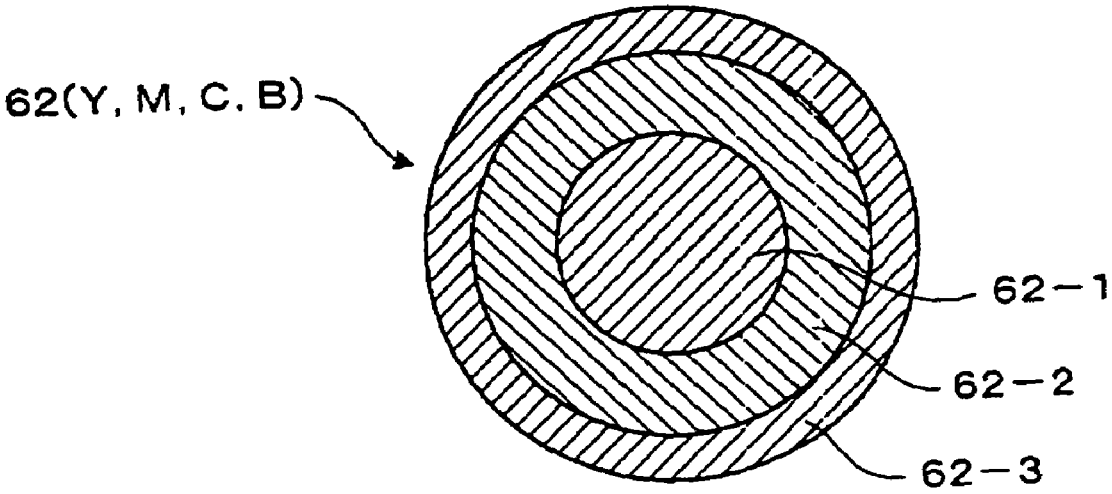
FIG. 4 is a section showing a specific configuration of an image transfer roller included in Example 1.

As shown in FIG. 4 specifically, the image transfer roller 62 is made up of a cylindrical conductive base 62-1, an annular resistance layer 62-2 formed on the base 62-1, and an annular surface layer 62-3 formed on the resistance layer 62-2.

The base 62-1 has a diameter of about 8 mm to about 20 mm and is formed of, e.g., stainless steel, aluminum or similar highly rigid, conductive metal or highly rigid, conductive resin having volume resistivity of $1\times10^3$ Ω·cm$^3$ or below, preferably $1\times10^2$ Ω·cm$^3$ or below. In this specific configuration, the base 62-1 constitutes the shaft of the image transfer roller 62.

The resistance layer 62-2 has volume resistivity of about $1\times10^5$ Ω·cm$^3$ to about $1\times10^9$ Ω·cm$^3$ and is about 1 mm to about 2 mm thick. The volume resistivity of the surface layer 62-3 should preferably be slightly higher than that of the resistance layer 62-2 and is selected to be between about $1\times10^6$ Ω·cm$^3$ and about $1\times10^{10}$ Ω·cm$^3$. The surface layer 62-3 may be about 10 μm thick. In this manner, the resistance layer 62-2 and surface layer 62-3 both are formed of a medium resistance body.

The resistance layer 62-2 is made up of a base material and a conducting material dispersed in the base material. For the base material, use may be made of any general-purpose resin easy to process, e.g., polyethylene (PE), polypropylene (PP) or similar olefin resin, polystyrene (PS), copolymer thereof (AS or ABS) or similar styrene resin or polymethyl methacrylate (PMMA) or similar acrylic resin. The conducting material may be selected from a group of alkaline metal salts including lithium peroxide, a group of perchlorates including sodium perchlorate, a group of tetra ammonium salts including tetrabuthyl ammonium salt, and a group of ion-conductive materials including a polymeric conducting material. Alternatively, the conducting material may be implemented by KETJENBLACK, Acetylene Black or similar carbon black.

The surface layer 62-3 may also be made up of a base material and a conducting material dispersed in the base material. The base material may be implemented by any suitable resin, e.g., fluoric resin, silicone resin, acrylic resin, polyamide resin, polyester resin, polyvinyl butyric resin or polyurethane resin. The base material should preferably be of the kind allowing a minimum of toner to deposit on the surface layer 62-3. For the conducting material, use may be made of, e.g., KETJENBLACK, Acetylene Black or similar carbon black or an electron-conductive conducting material constituted by indium oxide, tin oxide or similar metal oxide.

The belt 10 may be formed of any one of various conventional materials. For example, there may be used a belt formed of polyimide having high durability and high Young's modulus, a belt formed of polyvinylidene fluoride (PVDF) implementing high surface smoothness or a laminate belt having an elastic surface. The laminate belt may include a polyurethane resin layer, a polyurethane rubber layer formed on the resin layer, and a coat layer formed on the rubber layer and containing a fluoric component. This kind of laminate belt with an elastic surface can closely contact the surface of a sheet and is therefore desirable for the secondary image transfer. In any case, to enhance image transferability, the belt has volume resistivity of about $10^{10}$ Ω·cm$^3$ to about $10^{12}$ Ω·cm$^3$ and has surface resistance of $10^{12}$ Ω/□ or above in its toner image forming area. It is to be noted that while the unit of surface resistance is dimensionless, it is represented by Ω/□ herein so as to be distinguished from usual resistivity.

Toner with high circularity usable for development will be described hereinafter. To measure circularity, the shapes of a great number of toner particles arbitrarily selected may be observed by a scanning electronic microscope or an optical microscope and then estimated by, e.g., FPIA-1000 (trade name) available from SYSMEX CORPORATION or similar flow type particle image analyzer. This analyzer picks up the image of several thousands of particles present in a liquid and then analyzes the image and particle size. In this case, circularity is produced by:

$$\text{circularity}=\Sigma[4\cdot\pi\cdot Si/Li^2]/N$$

where Li denotes the circumferential length of each particle as measured on the image, Si denotes a projection area, and N denotes the total number of particles subject to measurement; each toner particle becomes more spherical as the circularity approaches 1.

Spherical toner with mean circularity of 0.94 or above is advantageous in that a minimum of toner transferred to the belt 10 at the upstream image forming station is reversely transferred to the drum of the downstream image forming station. Such reverse toner transfer occurs when an image transfer bias is applied at the downstream image forming station in order to transfer a toner image from the drum to the belt 10 and occurs particularly in the non-image portions of the drum.

Reverse toner transfer stated above is ascribable to an adhering force acting between the toner and the drum. The closer the shape of the toner to a sphere, the weaker the Van der Wàals' forces acting between the toner and the surface of the drum and therefore the smaller the ratio of reverse toner transfer. Generally, Van der Wàals' forces decreases with a decrease in the area over which the toner contacts the drum. More specifically, the closer the toner to a sphere, the smaller the contact area of the toner itself and, further, the higher the fluidity of the toner. Consequently, the probability that portions where silica and titanium oxide, which are added to the toner for increasing the adhering force, are present on the toner surfaces contact the drum increases. Such additives on the toner surfaces are far smaller in size than the toner, so that apparent Van der Wàals' forces decreases.

It is generally known that reverse toner transfer can be more positively obviated if the mean circularity of toner is 0.94 or above.

Figure 6A:
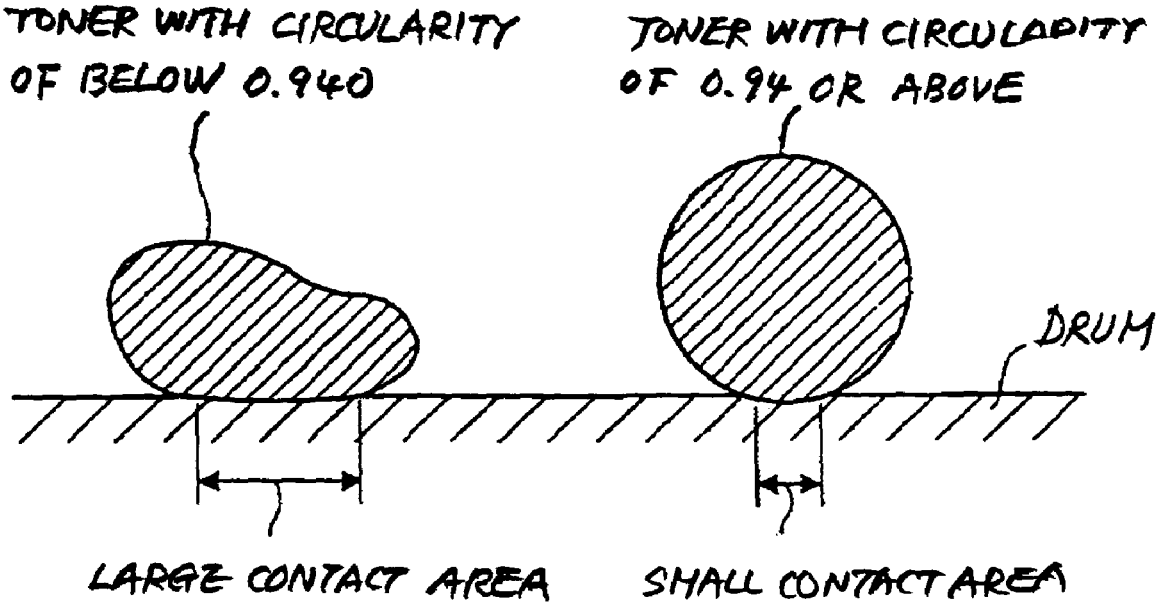
FIGS. 6A and 6B demonstrate how an adhering force acts between a photoconductive drum and toner.
Figure 6B:
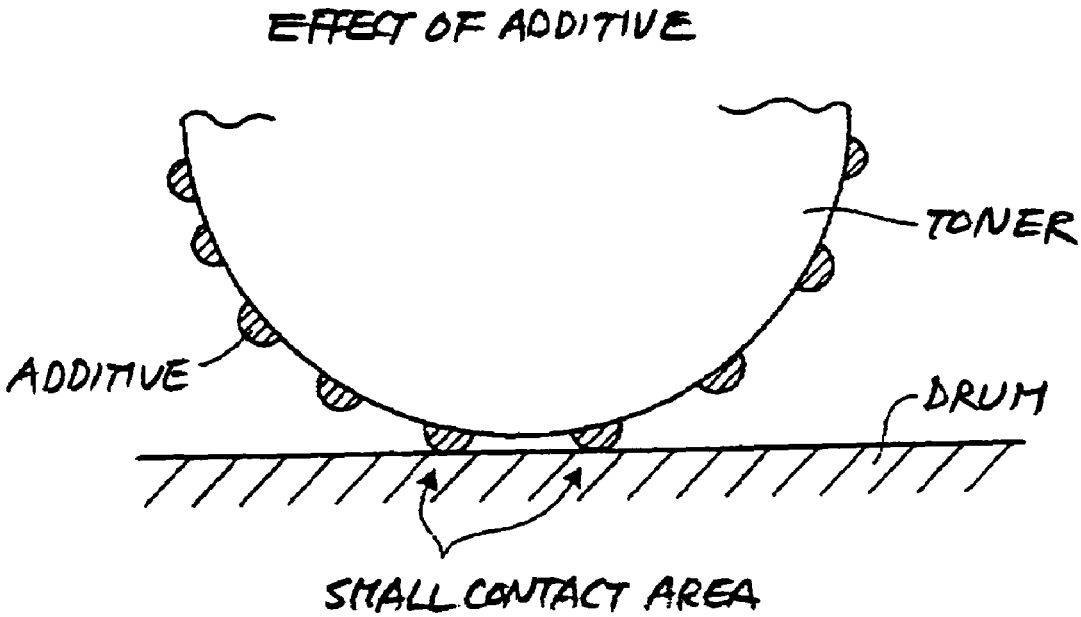
Figure 7:
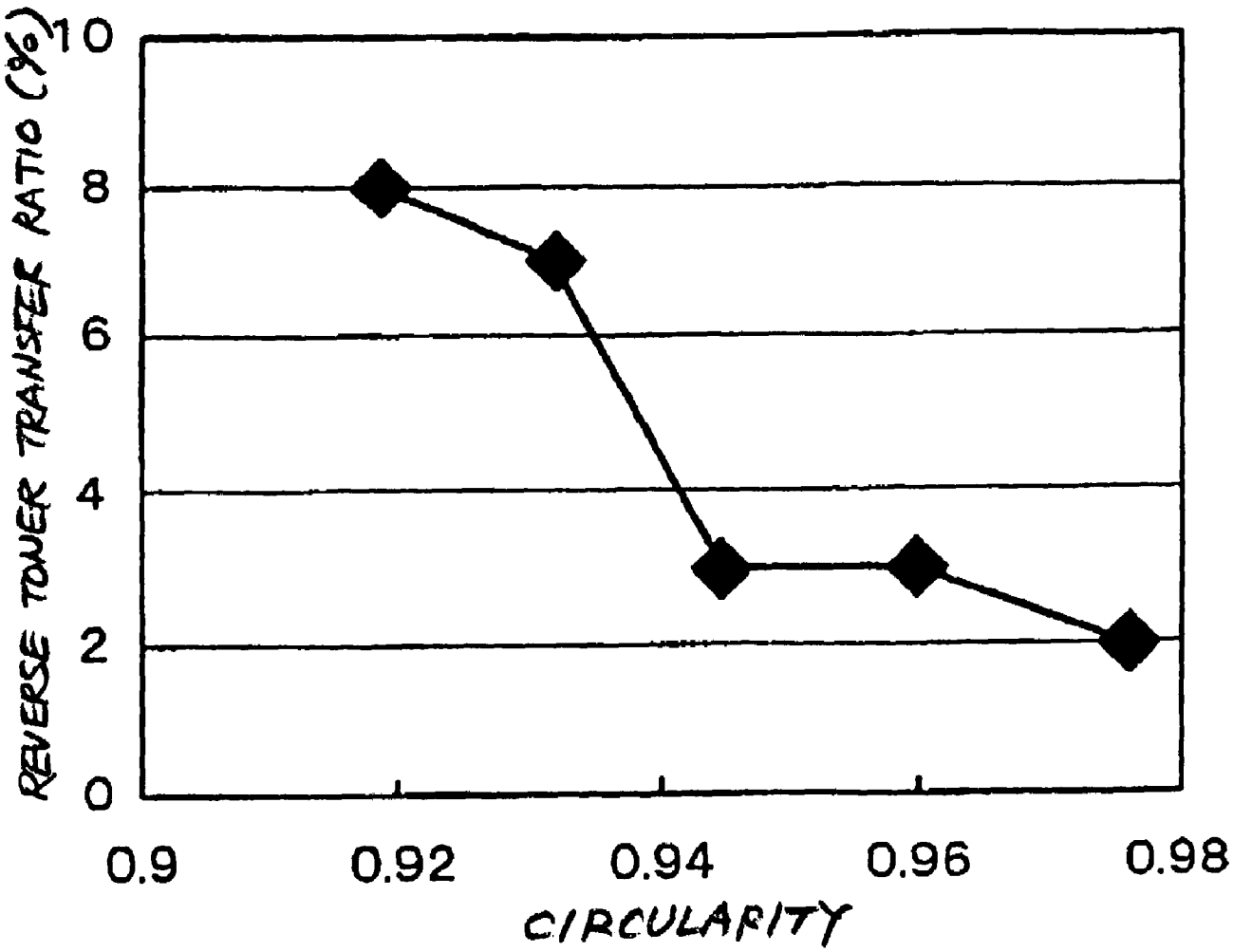
FIG. 7 is a graph showing a relation between the circularity of toner and a reverse transfer ratio.

More specifically, as shown in FIG. 6A, the contact area of toner close to a sphere with the drum is small, so that the adhering force acting between the toner and the drum is weak. Consequently, as shown in FIG. 6B, the effect of the additives appearing on the surface of the toner is presumably more prominent. If the above adhering force is weak, then the image transfer ratio is expected to increase while reverse toner transfer is expected to occur little. FIG. 7 is a graph showing reverse toner transfer ratios measured under usual conditions with sample toners actually produced and different in mean circularity from each other. As FIG. 7 indicates, reverse toner transfer noticeably decreases when mean circularity is 0.94 or above than when it is lower than 0.94. It follows that the mean circularity of toner should preferably be 0.94 or above.

With the configuration of toner described above, it is possible to reduce reverse toner transfer while maintaining images attractive and therefore to obviate the mixture of waste toners of different colors ascribable to reverse transfer. Therefore, in a tandem, image forming apparatus in which a particular developing unit is assigned to each photoconductive drum, waste toner collected from a drum by a drum cleaner is mostly toner deposited on the drum and can therefore be returned to the developing device for reuse without effecting tonality or otherwise degrading image quality. This realizes toner recycling to thereby noticeably reduce the amount of waste toner and therefore reduces environmental burden of waste products while saving cost, time and labor required of the user of the copier.

On the other hand, a so-called one drum, intermediate image transfer type of image forming apparatus, including a plurality of developing units arranged around a single drum, has a problem that even if reverser toner transfer does not occur, toners left on the drum at consecutive image forming stages are collected by a single drum cleaner and therefore mixed together and unable to be reused. It follows that only the tandem, image forming apparatus shown in FIGS. 1 and 2 can implement toner recycling.

Figure 5:
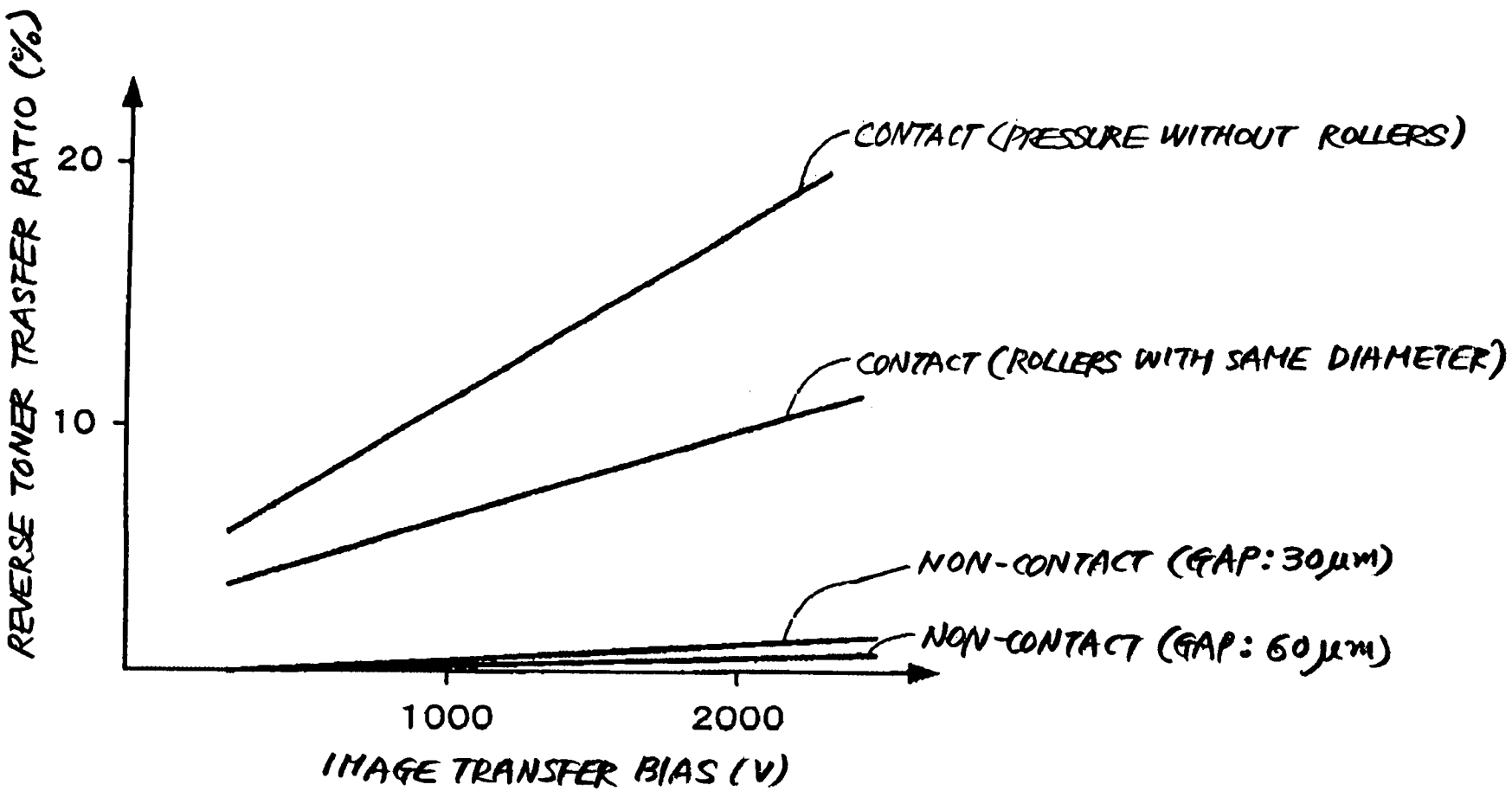
FIG. 5 is a graph showing a relation between a bias voltage for image transfer applied to an image transfer roller and a reverse transfer ratio.

FIG. 5 is a graph showing a relation between an image transfer voltage applied to the image transfer roller and reverse toner transfer determined by varying the configurations of the intermediate image transfer belt and image transfer roller and the gap. In FIG. 5, a reverse toner transfer ratio refers to the ratio of the amount of toner returned from the intermediate image transfer belt to the drum. A DC voltage or an AC-biased DC voltage was applied to the image transfer roller when the roller contacted the intermediate image transfer belt or when the former did not contact the latter, respectively. The AC bias for image transfer had a peak-to-peak voltage of 2 kV and a frequency of 1.4 kHz when the gap was 30 μm or had a peak-to-peak voltage of 2.3 kV and a frequency of 1.4 kHz when the gap was 60 μm.

As FIG. 5 indicates, the gap is successful to reduce the reverse toner transfer ratio. However, the reverse toner transfer ratio does not always decrease when the gap is simply increased. FIG. 8 is a table showing a relation between the gap between the intermediate image transfer belt and the image transfer roller and the image transfer ratio, reverse toner transfer ratio and optimum image transfer voltage. The relation shown in FIG. 5 was obtained when the image transfer voltage was matched to the optimum image transfer ratio. As shown, a large gap eventually reduces the reverse toner transfer ratio, but reduces the image transfer ratio at the same time and thereby lowers image quality. It is therefore necessary to adequately control the gap. In practice, the gap should preferably be 100 μm or below, more preferably between 20 μm and 50 μm.

When the gap exists between the belt 10 and the image transfer roller 62, it is preferable to apply an AC-biased DC voltage to the roller 62 although only an AC voltage suffices. More specifically, if electric resistance in a current path formed by the resistance layer 62-2 and surface layer 62-3 of the image transfer roller 62 is not uniform, it is likely that a DC voltage applied to the roller 62 alone makes charge deposited on the inner surface of the belt 10 not uniform. By contrast, an AC-biased DC voltage applied to the image transfer roller 62 makes the potential on the surface of the image transfer roller 62 identical, thereby stabilizing discharge and therefore realizing desirable image transfer.

The peak-to-peak voltage of the AC to be applied to the image transfer roller 62 should preferably be two times or more higher than the charge start voltage on the inner surface of the belt 10. In this condition, even if electric resistance in the current path of the image transfer roller 62 is not uniform due to discharge from the inner surface of the belt 10 to the roller 62, i.e., reverse toner discharge, the inner surface of the belt 10 can be uniformly charged to a more stable state by the leveling effect of the AC voltage. A charge start voltage mentioned above refers to the absolute value of a DC voltage applied to the image transfer roller 62 alone and causing, when raised in absolute value little by little, the inner surface of the image transfer belt 10 to start being charged. The DC voltage may be subject to constant current control, if desired.

As stated above, in Example 1, the rollers 90 positioned at both sides of the image transfer roller 62 are provided with a larger diameter than the roller 62 so as to form a gap between the belt 10 and the roller 62. With this configuration, it is possible to reduce pressure to act at the image transfer nip and therefore reverse toner transfer.

EXAMPLE 2

Figure 9:
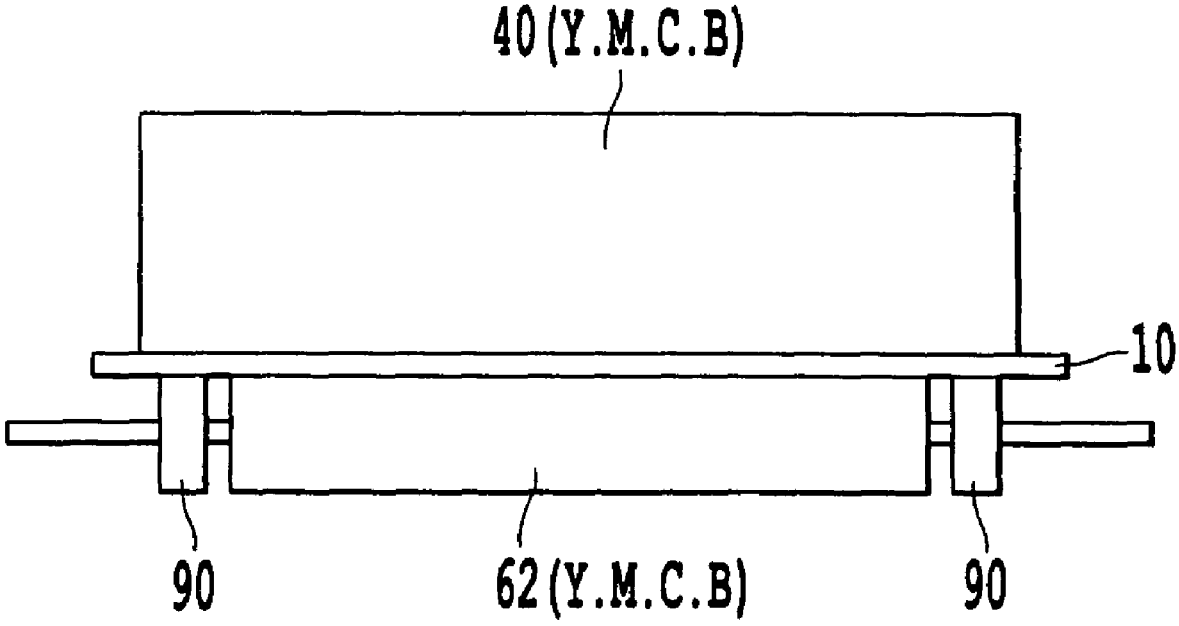
FIG. 9 shows an exemplary embodiment of one of a plurality of primary image forming stations of the present invention.

In Example 2, the rollers 90 are also positioned at opposite sides of the image transfer roller 62, which contacts the inner surface of the belt 10, as shown in FIG. 9. Example 2 is identical with Example 1 except that the rollers 90 have the same diameter as the image transfer roller 62. FIG. 8 additionally shows experimental results derived from such a configuration for comparison. As shown, Example 2 successfully reduces the reverse toner transfer ratio, compared to the conventional system. Moreover, Example 2 makes it needless to apply an AC bias and therefore saves energy, compared to Example 1 that forms a gap between the belt 10 and the image transfer roller 62. In this manner, the rollers 90 identical in diameter with the image transfer roller 62 reduce pressure to act at the image transfer nip and therefore reverse toner transfer.

As stated above, in the illustrative embodiment, the rollers 90 are positioned at both sides of each image transfer roller 62 for controlling the nip width over which the drum 40 and belt 10 contact during image transfer. The rollers 90 form a gap between the belt 10 and the image transfer roller 62 or prevent the roller 62 from pressing the belt 10, allowing the belt 10 to extend horizontally. Therefore, a toner image formed on the drum 40 can be transferred to the belt 10 without any image transfer pressure acting on the belt 10. This realizes faithful transfer of the toner image while reducing reverse toner transfer. It follows that by applying the illustrative embodiment to a tandem, color image forming apparatus using the belt 10, it is possible to obviate color mixture, image disturbance and other defects ascribable to reverse toner transfer and therefore to achieve attractive color images. Such an apparatus may be implemented as a copier, printer, plotter or facsimile apparatus capable of forming multicolor images or full-color images.

In summary, it will be seen that the present invention provides a method and an apparatus for image formation capable of faithfully transferring toner images and reducing reverse toner transfer for thereby implementing toner recycling.

Various modifications will become possible for those skilled in the art after receiving the teachings of the present disclosure without departing from the scope thereof.

What is claimed is:

1. An image forming method of sequentially transferring toner images formed on an image carrier to an intermediate image transfer body, comprising:

forming a multicolor toner image on said intermediate image transfer body by positioning the image carrier above the intermediate image transfer body;

facing an image transfer roller towards an inside surface of said intermediate image transfer body;

applying an image transfer bias when a toner image is transferred from said image carrier to said intermediate image transfer body; and controlling a nip width over which the image carrier and the intermediate image transfer body contact each other during image transfer by positioning rollers to be in contact with the intermediate image transfer body and be at both sides of the image transfer roller in an axial direction of the image transfer roller; and positioning said image transfer roller and the intermediate image transfer body so that the image transfer roller and the intermediate image transfer body are not in contact with each other during the image transfer.

2. The image forming method as claimed in claim 1, wherein the controlling the nip width includes selecting said rollers to have a larger diameter than said image transfer roller.

3. The image forming method as claimed in claim 2, wherein the controlling the nip width includes selecting the rollers to have a diameter so a distance between said image transfer roller and the intermediate image transfer body is 100 μm or below.

4. The image forming method as claimed in claim 2, wherein the applying the image transfer bias includes applying an AC-biased DC voltage to the image transfer roller.

5. The image forming method as claimed in claim 2, wherein the facing the image transfer roller towards the inside surface of the intermediate image transfer body includes facing the image transfer roller that includes a conductive base, a resistance layer affixed to said base and a surface layer formed on said resistance layer, and said surface layer includes a base material and an electron-conductive conducting material dispersed in said base material.

6. The image forming method as claimed in claim 5, wherein the facing the image transfer roller towards the inside surface of the intermediate image transfer body includes facing the image transfer roller that includes said surface layer selected to have a higher volume resistivity than said resistance layer.

7. The image forming method as claimed in claim 1, wherein the sequentially transferring toner images formed on an image carrier to an intermediate image transfer body includes transferring toner images formed on an image carrier to and intermediate image transfer body that includes an endless belt.

8. The image forming method as claimed in claim 1, further comprising:

utilizing toner for image formation that has circularity of 0.94 or above.

9. The image forming method as claimed in claim 1, further comprising:

providing a cleaning device disposed to each image carrier for collecting toner left on each image carrier without being transferred to said intermediate image transfer body;

returning the toner collected by each of said cleaning devices to developing units that corresponds in color to said cleaning devices; and reusing the toner returned to each developing unit.

10. An image forming apparatus, comprising:

an image carrier;

means for forming a toner image on said image carrier;

an intermediate image transfer body to which said toner image is transferred from said image carrier;

an image transfer roller configured to face an inside surface of said intermediate image transfer body to apply an image transfer bias when the toner image is transferred from said image carrier to said intermediate image transfer body; and rollers in contact with the intermediate image transfer body are positioned at both sides of said image transfer roller in an axial direction of said image transfer roller, wherein the rollers are configured to control a nip width over which the image carrier and the intermediate image transfer body contact each other during image transfer and to prevent the image transfer roller and the intermediate image transfer body from contacting each other during the image transfer.

11. The image forming apparatus according to claim 10, wherein the rollers have a larger diameter than a diameter of the image transfer roller.

12. The image forming apparatus according to claim 11, wherein a distance between the image transfer roller and the intermediate image transfer body is 100 μm or less.

13. The image forming apparatus according to claim 11, wherein the image transfer bias includes an AC-biased DC voltage.

14. The image forming apparatus according to claim 11, wherein the image transfer roller includes a conductive base, a resistance layer affixed to the conductive base and a surface layer formed on the resistance layer, and the surface layer includes a base material and an electron-conductive conducting material dispersed in the base material.

15. The image forming apparatus according to claim 14, wherein the surface layer has a higher volume resistivity than the resistance layer.

16. An image forming apparatus, comprising:

an image carrier;

an intermediate image transfer body to which a toner image is transferred from the image carrier;

an image transfer roller facing an inside surface of the intermediate image transfer body, configured to apply an image transfer bias to transfer the toner image from the image carrier to the intermediate image transfer body; and rollers in contact with the intermediate image transfer body positioned at both sides of the image transfer roller in an axial direction of the image transfer roller, wherein the rollers are configured to control a nip width over which the image carrier and the intermediate image transfer body contact each other during image transfer and to prevent the image transfer roller and the intermediate image transfer body from contacting each other during the image transfer.

* * * * *